US012788058B2

(12) United States Patent
Wu

(10) Patent No.: US 12,788,058 B2
(45) Date of Patent: Nov. 10, 2026

(54) VAPORIZER AND ELECTRONIC VAPORIZATION DEVICE

(71) Applicant: SHENZHEN SMOORE TECHNOLOGY LIMITED, Shenzhen (CN)

(72) Inventor: Juntao Wu, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 881 days.

(21) Appl. No.: 17/815,433

(22) Filed: Jul. 27, 2022

(65) Prior Publication Data

US 2023/0035530 A1 Feb. 2, 2023

(30) Foreign Application Priority Data

Jul. 29, 2021 (CN) ..... 202121758916.5

(51) Int. Cl.
*A24F 40/40* (2020.01)
*A24F 40/10* (2020.01)

(52) U.S. Cl.
CPC ..... *A24F 40/40* (2020.01); *A24F 40/10* (2020.01)

(58) Field of Classification Search
CPC ..... A24F 40/10; A24F 40/40; A24F 40/485; A24F 40/42; A24F 40/51; A24F 40/60
See application file for complete search history.

(56) References Cited

U.S. PATENT DOCUMENTS

2018/0360121 A1 12/2018 Jiang et al.
2021/0145052 A1 5/2021 Fu et al.

FOREIGN PATENT DOCUMENTS

| | | | | | |
|---|---|---|---|---|---|
| CN | 210672095 | U | | 6/2020 | |
| CN | 211211458 | U | | 8/2020 | |
| CN | 211407644 | U | | 9/2020 | |
| CN | 112021659 | A | | 12/2020 | |
| CN | 112316258 | A | | 2/2021 | |
| KR | 20190100474 | A | * | 8/2019 | ..... A24F 47/008 |
| KR | 1020210093492 | A | | 7/2021 | |

(Continued)

OTHER PUBLICATIONS

English Description Translation of WO 2022161256 A1 obtained from Espacenet (Year: 2025).*

(Continued)

*Primary Examiner* — Alicia J Weydemeyer
*Assistant Examiner* — Laura B Figg
(74) *Attorney, Agent, or Firm* — Leydig, Voit & Mayer, Ltd.

(57) ABSTRACT

A vaporizer includes: a housing having a side wall and a housing bottom connected to the side wall, the side wall and the housing bottom forming an accommodation cavity, the housing bottom including an inner bottom surface, an air inlet being provided on the side wall; a vaporization base located in the accommodation cavity and close to the inner bottom surface, there being a gap between the vaporization base and the housing bottom, an air inlet hole being provided on the vaporization base, the air inlet hole being in communication with the air inlet through the gap; and a vaporization core located in the accommodation cavity and mounted on the vaporization base, the vaporization core being in communication with the air inlet hole.

20 Claims, 7 Drawing Sheets

(56) References Cited

FOREIGN PATENT DOCUMENTS

| | | | | | |
|---|---|---|---|---|---|
| WO | WO-2019218122 | A1 * | 11/2019 | ..... | A24F 40/485 |
| WO | 2020084799 | A1 | 4/2020 | | |
| WO | 2020259692 | A1 | 12/2020 | | |
| WO | 2021062779 | A1 | 4/2021 | | |
| WO | WO-2022161256 | A1 * | 8/2022 | ..... | A61M 11/042 |

OTHER PUBLICATIONS

English Description Translation of WO 2019218122 A1 obtained from Espacenet (Year: 2025).*
European Patent Office, Search Report in European Patent Application No. 22187611.3 (Dec. 1, 2022).
Japanese Patent Office, Notice of Reasons for Refusal in Japanese Patent Application No. 2022-120101 (Sep. 5, 2023).
Korean Patent Office, Written Decision on Registration in Korean Patent Application No. 10-2022-0093203 (Sep. 24, 2024).
European Patent Office, Office Action in European Patent Application No. 22187611.3 (Oct. 11, 2024).

* cited by examiner

VAPORIZER AND ELECTRONIC VAPORIZATION DEVICE

CROSS-REFERENCE TO PRIOR APPLICATION

Priority is claimed to Chinese Patent Application No. CN 202121758916.5, filed on Jul. 29, 2021, the entire disclosure of which is hereby incorporated by reference herein.

FIELD

The present application relates to the field of vaporization technologies, and in particular, to a vaporizer and an electronic vaporization device.

BACKGROUND

The electronic vaporization device is an electronic product that generates aerosol by heating a vaporizable medium. The electronic vaporization device generally includes a vaporizer and a power supply assembly. The vaporizer includes components such as a base, a liquid storage tank, a heating body, a liquid guide body, and a silicone sealant, where the liquid storage tank is in communication with the liquid guide body, the liquid guide body is in contact with the heating body, the heating body is mounted on the base, and the mounting base is connected to the power supply assembly. During use, the vaporizer guides the vaporizable medium in the liquid storage tank to the heating body through the liquid guide body for heating, so that the vaporizable medium is vaporized to generate aerosol, and then the aerosol is outputted from an air outlet channel together with air entering through an air inlet hole, for a user to inhale.

However, condensed liquid formed during use of an existing vaporizer is likely to flow towards the air inlet hole due to the gravity and/or other forces, and consequently, a short circuit of a microphone and a battery cell of a battery compartment is likely to occur, blocking the flow of air and causing a potential safety hazard.

SUMMARY

In an embodiment, the present invention provides a vaporizer, comprising: a housing comprising a side wall and a housing bottom connected to the side wall, the side wall and the housing bottom forming an accommodation cavity, the housing bottom comprising an inner bottom surface, an air inlet being provided on the side wall; a vaporization base located in the accommodation cavity and close to the inner bottom surface, there being a gap between the vaporization base and the housing bottom, an air inlet hole being provided on the vaporization base, the air inlet hole being in communication with the air inlet through the gap; and a vaporization core located in the accommodation cavity and mounted on the vaporization base, the vaporization core being in communication with the air inlet hole.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
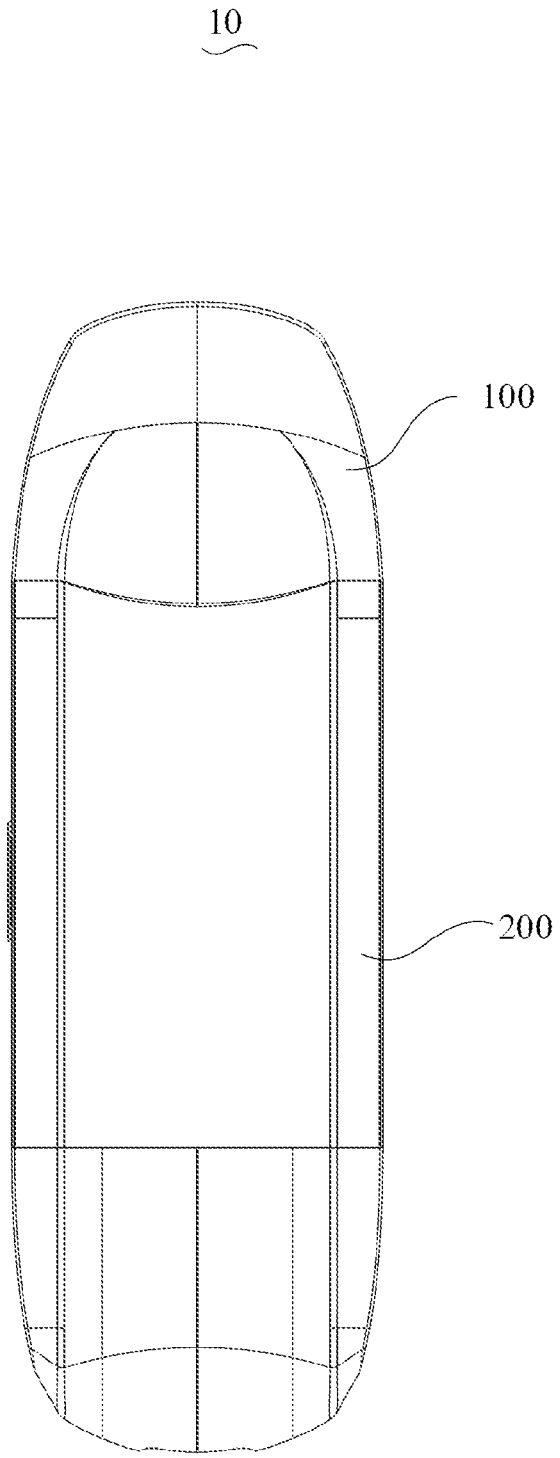
FIG. 1 shows an electronic vaporization device according to an embodiment.

In an embodiment, the present invention provides a safer vaporizer and electronic vaporization device.

In an embodiment, the present invention provides a vaporizer, including:

- a housing, including a side wall and a housing bottom connected to the side wall, where the side wall and the housing bottom form an accommodation cavity, the housing bottom includes an inner bottom surface, and an air inlet is provided on the side wall;
- a vaporization base, located in the accommodation cavity and close to the inner bottom surface, where there is a gap between the vaporization base and the housing bottom, an air inlet hole is provided on the vaporization base, and the air inlet hole is in communication with the air inlet through the gap; and
- a vaporization core, located in the accommodation cavity and mounted on the vaporization base, where the vaporization core is in communication with the air inlet hole.

The vaporizer includes the housing, the vaporization base, and the vaporization core. The air inlet is provided on the side wall of the housing, so that liquid flowing out of the air inlet hole cannot flow towards a battery assembly through the air inlet, and the battery assembly is less prone to short circuits, which has better safety performance. In addition, since the air inlet is not in direct communication with the air inlet hole but is in communication with the air inlet hole through a gap between the vaporization base and a base, to prevent the air inlet hole from being blocked by the liquid to block the flow of air.

In an embodiment, a liquid storage groove is provided on one side of the vaporization base close to the inner bottom surface, so that liquid flowing out of the air inlet hole is flowable into the liquid storage groove under a capillary force.

In an embodiment, a liquid storage groove and a liquid guide trench are provided on one side of the vaporization base close to the inner bottom surface, the liquid guide trench is located between the air inlet hole and the liquid storage groove, and the liquid guide trench is configured to guide liquid flowing out of the air inlet hole into the liquid storage groove.

In an embodiment, an opening of the liquid storage groove faces the inner bottom surface, and there is a spacing between one side of the liquid storage groove close to the inner bottom surface and the inner bottom surface.

In an embodiment, the housing includes a top cover and a bottom cover, the top cover is detachably connected to the bottom cover, the top cover and the bottom cover form the accommodation cavity for accommodating the vaporization base and the vaporization core, and the inner bottom surface is a surface of the bottom cover close to the vaporization base; and the liquid storage groove includes an opening facing the bottom cover, there is a spacing between one side of the liquid storage groove close to the bottom cover and the bottom cover, and the air inlet is located on a side wall of the bottom cover, on a side wall of the top cover, or at a joint between the top cover and the bottom cover.

In an embodiment, the bottom cover is a hollow structure with one end open and an other end closed; the vaporization base is located inside the bottom cover, a side wall of the vaporization base is connected to an inner side wall of the bottom cover in a sealed manner, and one side of the vaporization base close to the bottom cover and the bottom cover form an air inlet channel; and the air inlet is located on the side wall of the bottom cover and is in communication with the air inlet channel, and the air inlet channel is in communication with the air inlet hole.

In an embodiment, the air inlet hole is located in the middle of the vaporization base, and an air groove is provided on one side of the vaporization base close to the bottom cover; and the air groove is in communication with the liquid guide trench, a groove wall of the air groove is in contact with the bottom cover to form the air inlet channel, and a notch is provided on the groove wall of the air groove close to the air inlet hole, where the notch is configured to cause the air inlet channel to be in communication with both the opening of the liquid storage groove and the air inlet hole.

In an embodiment, a cross-section of the housing is elliptical, and an orthographic projection of the air inlet on the cross-section of the housing is located on a major axis of the cross-section.

In an embodiment, there are two air inlets, and orthographic projections of the two air inlets on the cross-section of the housing coincide with endpoints of the major axis.

In an embodiment, the vaporization core includes a heating assembly and a liquid storage tank that is configured to carry a vaporizable medium; the heating assembly is mounted on the vaporization base, the heating assembly is configured to vaporize the vaporizable medium in the liquid storage tank, and the heating assembly and the vaporization base form a vaporization cavity; and the air inlet hole is in communication with the vaporization cavity, the housing is further provided with an air outlet, and the air outlet is in communication with the vaporization cavity.

In an embodiment, the heating assembly includes a liquid guide member and a heating member; the heating member is mounted on the vaporization base, and the liquid guide member is located between the liquid storage tank and the heating member; and the vaporizable medium in the liquid storage tank reaches the heating member through the liquid guide member and is vaporized by the heating member.

In an embodiment, the liquid storage tank includes a tank housing and a tank cover; the tank housing includes a liquid storage cavity, and the liquid storage cavity includes an exit; the tank cover is located on the vaporization base, and the tank cover covers the tank housing and blocks the exit, and is connected to the tank housing in a sealed manner; a liquid outlet channel is provided on the tank cover, the liquid outlet channel includes a liquid inlet and a liquid outlet, and the liquid inlet is in communication with the exit; an edge of the liquid guide member is connected to an end of the liquid outlet channel close to the liquid outlet in a sealed manner; and/or the liquid guide member is a porous ceramic body.

In an embodiment, an air outlet channel is provided on the tank cover and/or the vaporization base, and the vaporization cavity is in communication with the air outlet channel, so that the air outlet channel is in communication with the air outlet.

An electronic vaporization device is provided, including the foregoing vaporizer and a battery assembly, where the battery assembly is electrically connected to a vaporization core of the vaporizer.

REFERENCE NUMERALS

10—Electronic vaporization device; 100—Vaporizer; 200—Battery assembly; 110—Housing; 120—Vaporization base; 130—Vaporization core; 111—Inner bottom surface; 112—Air inlet; 121—Air inlet hole; 122—Liquid storage groove; 123—Liquid guide trench; 113—Top cover; 114—Bottom cover; 124—Air groove; 131—Liquid storage tank; 132—Heating assembly; 133—Vaporization cavity; 115—Air outlet; 134—Liquid guide member; 135—Heating member; 131*a*—Tank housing; 131*b*—Tank cover; 131*c*—Liquid storage cavity; 131*d*—Liquid outlet channel; 136—First seal member; 137—Second seal member; 210—Power supply; 220—Battery case; 231—Ejector pin; and 116—Third channel.

To help understand the present application, the following describes the present application more comprehensively with reference to the related accompanying drawings. The accompanying drawings show some embodiments of the present application. However, the present application may be implemented in many different forms, and is not limited to the embodiments described in this specification. On the contrary, the embodiments are provided to make the disclosed content of the present application more comprehensive.

It should be noted that, when a component is expressed as "being fixed to" another component, the component may be directly on the another component, or one or more intermediate components may exist between the component and the another component. When one component is expressed as "being connected to" another component, the component may be directly connected to the another component, or one or more intermediate components may exist between the component and the another component. When orientation or position relationships indicated by terms such as "vertical", "horizontal", "left", "right", "upper", "lower", "inside", "outside", and "bottom" are based on orientation or position relationships shown in the accompanying drawings, and are used merely for ease of description, rather than indicating or implying that the mentioned apparatus or component needs to have a particular orientation or needs to be constructed and operated in a particular orientation. Therefore, such terms should not be construed as limiting of this application. In addition, terms such as "first", and "second" are merely intended for a descriptive purpose and cannot be understood as indicating or implying relative importance.

Unless otherwise defined, meanings of all technical and scientific terms used in this specification are the same as those usually understood by a person skilled in the art to which the present application belongs. In this specification, terms used in the specification of the present application are merely intended to describe objectives of the specific embodiments, but are not intended to limit the present application.

Figure 2:
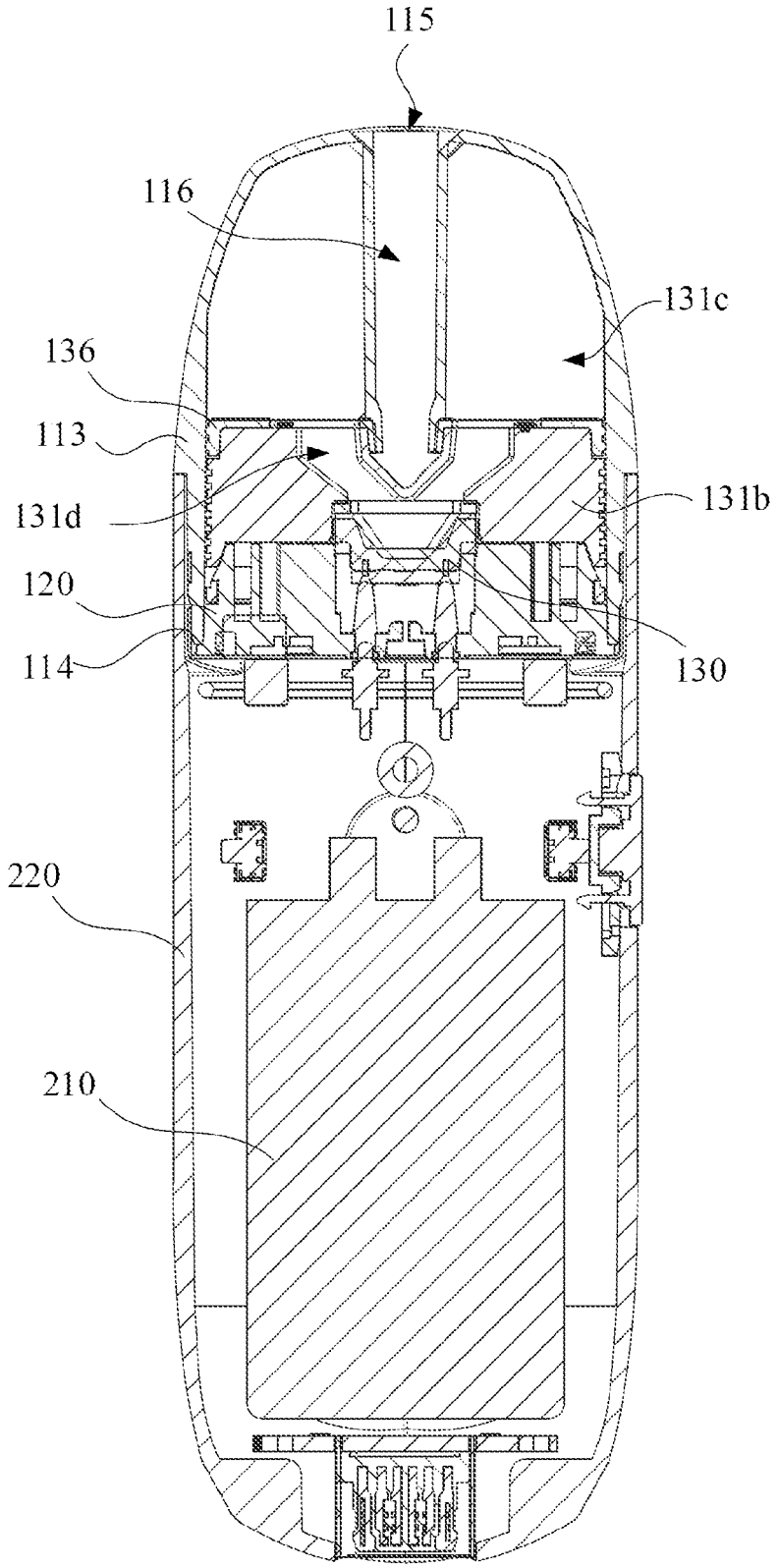
FIG. 2 is a cross-sectional view of the electronic vaporization device shown in FIG. 1.

Referring to FIG. 1 and FIG. 2, an implementation of this application provides an electronic vaporization device 10. The electronic vaporization device 10 includes a vaporizer 100 and a battery assembly 200, where the battery assembly 200 is electrically connected to the vaporizer 100, and the battery assembly 200 supplies power to the vaporizer 100.

Figure 3:
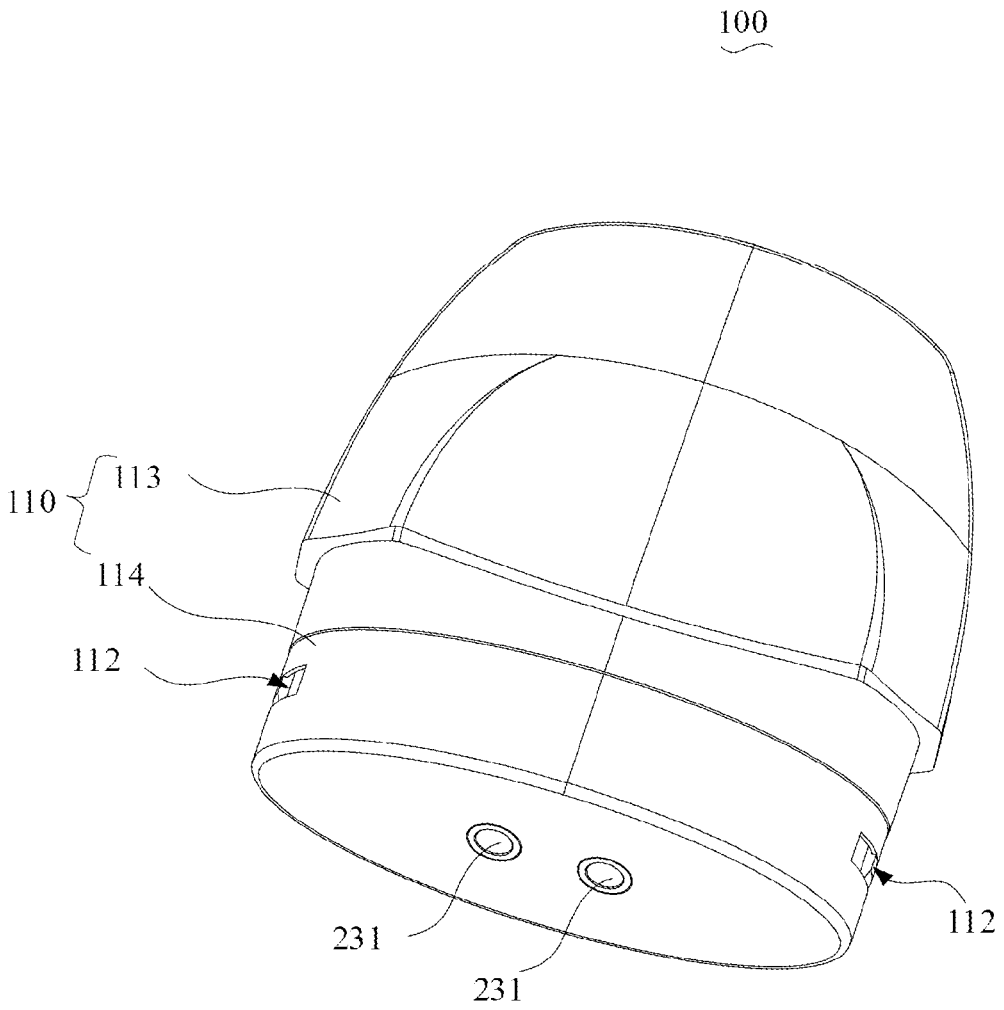
FIG. 3 is a three-dimensional view of a vaporizer of the electronic vaporization device shown in FIG. 1.
Figure 4:
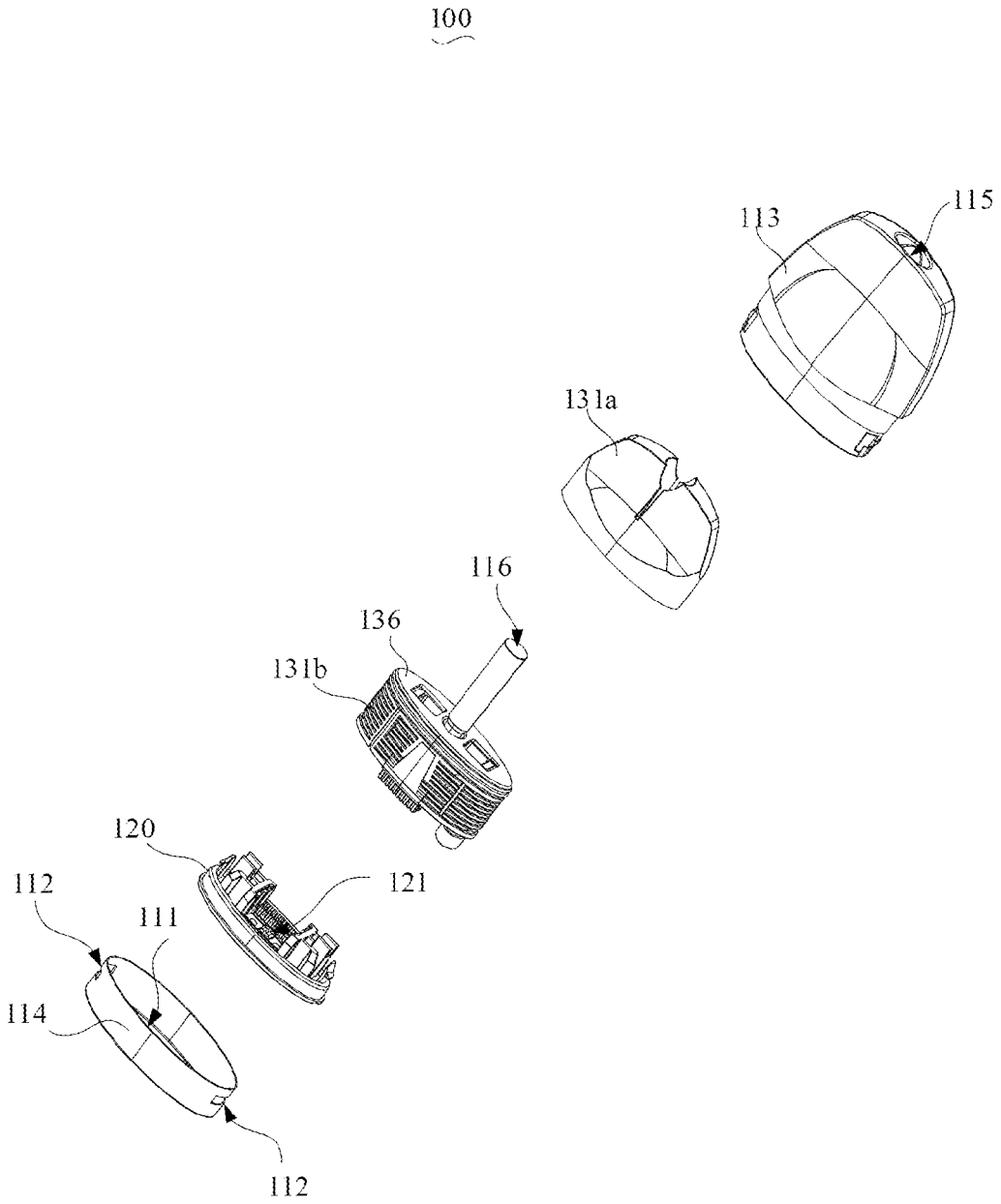
FIG. 4 is an exploded view of the vaporizer shown in FIG. 3.
Figure 5:
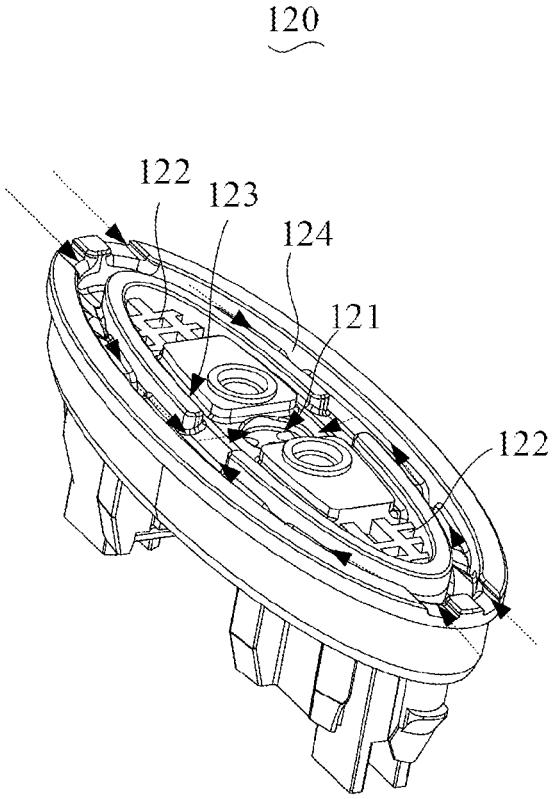
FIG. 5 is a three-dimensional view of a vaporization base of the vaporizer shown in FIG. 3.

Specifically, referring to FIG. 3 to FIG. 5 together, the vaporizer 100 is configured to vaporize a flowable vaporizable medium (for example, an oily substance). The vaporizer 100 includes a housing 110, a vaporization base 120, and a vaporization core 130 mounted on the vaporization base 120. The housing 110 includes a side wall and a housing bottom connected to the side wall. The side wall and the housing bottom form an accommodation cavity, the housing bottom includes an inner bottom surface 111, and an air inlet 112 is provided on the side wall. The vaporization base 120 and the vaporization core 130 are both located in the accommodation cavity, the vaporization base 120 is close to the inner bottom surface 111, there is a gap between the vaporization base 120 and the housing bottom, and an air inlet hole 121 is provided on the vaporization base 120. The air inlet 112 is in communication with the air inlet hole 121 through the gap between the vaporization base 120 and the housing bottom, and the air inlet hole 121 is in communication with the vaporization core 130.

During operation of the vaporizer 100, external air enters through the air inlet 112 and then flows into the vaporization core 130 sequentially through the gap between the vaporization base 120 and the housing bottom and the air inlet hole 121, and after the vaporizable medium is vaporized into aerosol by the vaporization core 130, the aerosol flows out of an air outlet 115 together with air in the vaporization core 130. In the foregoing vaporizer, the air inlet 112 is provided on the side wall of the housing, and the air inlet 112 is not in direct communication with the air inlet hole 121 but is in communication with the air inlet hole 121 through the gap between the vaporization base 120 and the housing bottom. Compared with a conventional vaporizer, the foregoing vaporizer 110 prevents condensed liquid formed by vaporizing the vaporizable medium by the vaporization core from flowing out of the air inlet hole 121 and flowing towards the battery assembly 200 through the air inlet 112, so that a short circuit of the battery assembly 200 caused by condensed liquid generated during use can be avoided. In addition, since the air inlet 112 is not in direct communication with the air inlet hole 121 but is in communication with the air inlet hole 121 through a gap between the vaporization base 120 and a base, the air inlet 112 or an air inlet channel is prevented from being blocked by the condensed liquid to block the flow of air.

In some embodiments, the air inlet 112 is close to the housing bottom. In some embodiments, the housing 110 further includes a top wall, the top wall is opposite to the housing bottom and is connected to the side wall. The side wall, the housing bottom, and the top wall jointly form the accommodation cavity. In this case, the air inlet 112 may alternatively be provided on the top wall.

In the illustrated embodiment, the air inlet 112 is in a shape of a square. Certainly, in other embodiments, the shape of the air inlet 112 is not limited to a square, and may alternatively be another shape, such as a circle.

Optionally, a cross-section of the housing 110 is elliptical, and an orthographic projection of the air inlet 112 on the cross-section of the housing 110 is located on a major axis of the cross-section of the housing 110. In the illustrated embodiment, the cross-section of the housing 110 is elliptical, there are two air inlets 112, and orthographic projections of the two air inlets 112 on the cross-section of the housing 110 coincide with endpoints of the major axis. It may be understood that, in other embodiments, the shape of the cross-section of the housing 110 is not limited to an ellipse, and may also be any other shape such as a rectangle, a circle, or a polygon. Certainly, in a case that the cross-section of the housing 110 is elliptical, a position of the air inlet 112 is not limited to the above, and may alternatively be another position on the housing 110. For example, the orthographic projection of the air inlet 112 on the cross-section of the housing 110 is close to an endpoint of the major axis, is close to an endpoint of a minor axis, or coincides with the endpoint of the minor axis. It may be understood that, in other embodiments, the quantity of air inlets 112 is not limited to two, and may alternatively be another value, for example, one or any integer greater than two.

Referring to FIG. 4, optionally, the housing 110 includes a top cover 113 and a bottom cover 114. The top cover 113 is detachably connected to the bottom cover 114, and the top cover 113 and the bottom cover 114 form an accommodation cavity for accommodating the vaporization base 120 and the vaporization core 130. The vaporization base 120 is located inside the bottom cover 114, and a surface on one side of the bottom cover 114 close to the vaporization base 120 is the inner bottom surface 111. The air inlet 112 is located on a side wall of the bottom cover 114, on a side wall of the top cover 113, or at a joint between the top cover 113 and the bottom cover 114. In this specification, the detachable connection includes, but is not limited to, at least one of a buckle connection, a threaded connection, or a magnetic connection. That the air inlet 112 is located at a joint between the top cover 113 and the bottom cover 114 means that a through hole is provided on each of the top cover 113 and the bottom cover 114, where the through hole on the top cover 113 and the through hole on the bottom cover 114 are located at a junction of the top cover 113 and the bottom cover 114, and the through hole of the top cover 113 and the through hole of the bottom cover 114 are communicated to form the air inlet 112. It may be understood that, in some embodiments, the top cover 113 may be omitted. When the top cover 113 is omitted, an end of a tank housing 131*a* close to a tank cover 131*b* is detachably connected to the bottom cover 114 to form the housing 110.

In some embodiments, a liquid storage groove 122 is provided on one side of the vaporization base 120 close to the inner bottom surface 111, so that liquid flowing out of the air inlet hole 121 is flowable into the liquid storage groove 122 under a capillary force. The liquid storage groove 122 is provided on the vaporization base 120, so that the liquid flowing out of the air inlet hole 121 flows into the liquid storage groove 122 under the capillary force and is stored without dripping onto the battery assembly 200, and the foregoing vaporizer 100 is less prone to short circuits, thereby improving the safety performance.

In some embodiments, a liquid storage groove 122 and a liquid guide trench 123 are provided on one side of the vaporization base 120 close to the inner bottom surface 111. The liquid guide trench 123 is located between the air inlet hole 121 and the liquid storage groove 122. The liquid guide trench 123 is configured to guide the liquid flowing out of the air inlet hole 121 into the liquid storage groove 122. The liquid storage groove 122 and the liquid guide trench 123 are provided on the vaporization base 120, so that the liquid flowing out of the air inlet hole 121 is easier to flow into the liquid storage groove 122 through the liquid guide trench 123 and is stored without dripping onto the battery assembly 200, and the foregoing vaporizer 100 is less prone to short circuits, thereby achieving better safety performance.

Referring to FIG. 5 (in FIG. 5, dashed arrows indicate directions of the flow of air) together, the liquid storage groove 122 includes an opening. Optionally, the opening faces the inner bottom surface 111, and there is a spacing between one side of the liquid storage groove 122 close to the inner bottom surface 111 and the inner bottom surface 111. One side of the liquid storage groove 122 close to the inner bottom surface 111 is spaced apart from the inner bottom surface 111, so that the liquid storage groove 122 is suspended above the inner bottom surface 111, thereby preventing the liquid flowing out of the air inlet hole 121 from reaching the inner bottom surface 111 through the liquid storage groove 122 due to the contact between an opening end of the liquid storage groove 122 and the bottom surface. It may be understood that, when the opening of the liquid storage groove 122 does not face the inner bottom surface 111, one side of the liquid storage groove 122 close to the inner bottom surface 111 may be in contact with the inner bottom surface 111. Certainly, in this case, one side of the liquid storage groove 122 close to the inner bottom surface 111 may alternatively not be in contact with the inner bottom surface 111. In a specific example, the liquid storage groove 122 is a hollow structure including an opening, the opening of the liquid storage groove 122 faces an inner side wall of the housing 110, and one of groove walls forming the opening is connected to the liquid guide trench 123 to enable liquid in the liquid guide trench 123 to flow into the liquid storage groove 122. In this case, one side of the liquid storage groove 122 close to the inner bottom surface 111 is in contact with or spaced apart from the inner bottom surface 111. In the illustrated embodiment, there are a plurality of liquid storage grooves 122, where the plurality of liquid storage grooves 122 are adjacent to each other and grid-shaped.

Referring to FIG. 4 and FIG. 5, in some embodiments, the bottom cover 114 is a hollow structure with one end open and an other end closed. The vaporization base 120 is located inside the bottom cover 114, an outer side wall of the vaporization base 120 is connected to an inner side wall of the bottom cover 114 in a sealed manner, and one side of the vaporization base 120 close to the bottom cover 114 and the bottom cover 114 form an air inlet channel. The air inlet 112 is located on the side wall of the bottom cover 114 and is in communication with the air inlet channel, and the air inlet channel is in communication with the air inlet hole 121. The liquid storage groove 122 is located between the air inlet channel and the air inlet hole 121, and the opening of the liquid storage groove 122 is in communication with the air inlet channel. It may be understood that, when the air inlet 112 is located on the bottom cover 114 and is close to the top cover 113 or is located on the top cover 113 to disable the air inlet 112 from being in direct communication with the air inlet channel, a channel may be provided on the vaporization base 120 and/or another component, to communicate the air inlet 112 with the air inlet channel.

In the embodiment shown in FIG. 5, the air inlet hole 121 is located in the middle of the vaporization base 120, and an air groove 124 is provided on one side of the vaporization base 120 close to the bottom cover 114. The air groove 124 is provided on an outer edge on one side of the vaporization base 120 close to the inner bottom surface 111, a groove wall of the air groove 124 is in contact with the bottom cover 114 to form the air inlet channel, and a notch is provided on the groove wall of the air groove 124 close to the air inlet hole 121, so that the air inlet channel is in communication with both the opening of the liquid storage groove 122 and the air inlet hole 121. In the illustrated embodiment, external air enters through air inlets 112 on two sides and then flows along the air groove 124 from the two sides to the air inlet hole 121 located in the middle. It may be understood that, in some embodiments, the air groove 124 may be omitted. When the air groove 124 is omitted, as long as there is a gap in communication with both the air inlet 112 and the air inlet hole 121 between the vaporization base 120 and the bottom cover 114, external air may flow into the air inlet hole 121 through the air inlet 112 and the gap. Certainly, the position of the air inlet hole 121 is not limited to the middle of the vaporization base 120, and may be adjusted according to an actual situation.

In the illustrated embodiment, the air inlet hole 121 is a circular hole; and there are five air inlet holes 121. Certainly, in other embodiments, the air inlet hole 121 is not limited to the circular hole, and may alternatively be in another shape. The quantity of air inlet holes 121 is not limited to five, and may alternatively be another value.

Optionally, the top cover 113 is a translucent plastic top cover; the bottom cover 114 is a stainless-steel bottom cover 114 (for example, an SPCC bottom cover); and the vaporization base 120 is a plastic vaporization base 120 (for example, a black plastic vaporization base 120). SPCC refers to Cold Rolled Carbon Steel Sheets and Strip. Certainly, in other embodiments, materials of both the top cover 113 and the vaporization base 120 are not limited to the above materials, and may alternatively be other materials.

Figure 6:
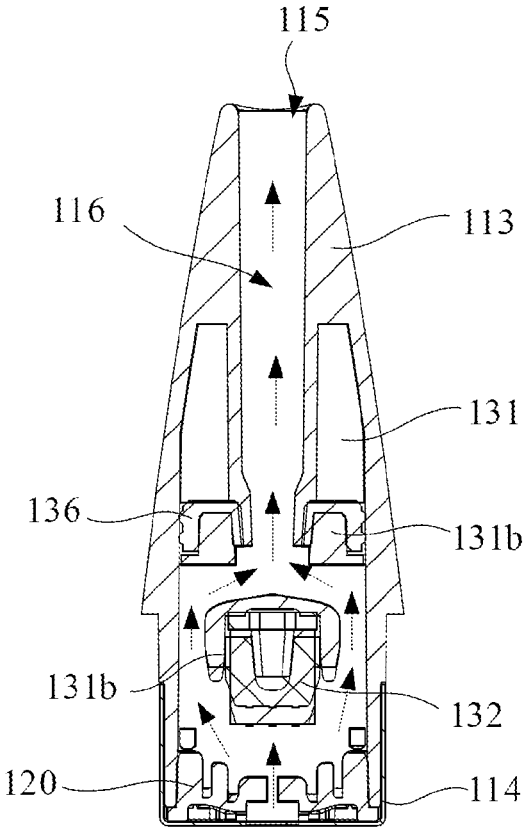
FIG. 6 is a cross-sectional view of the vaporizer shown in FIG. 3.
Figure 7:
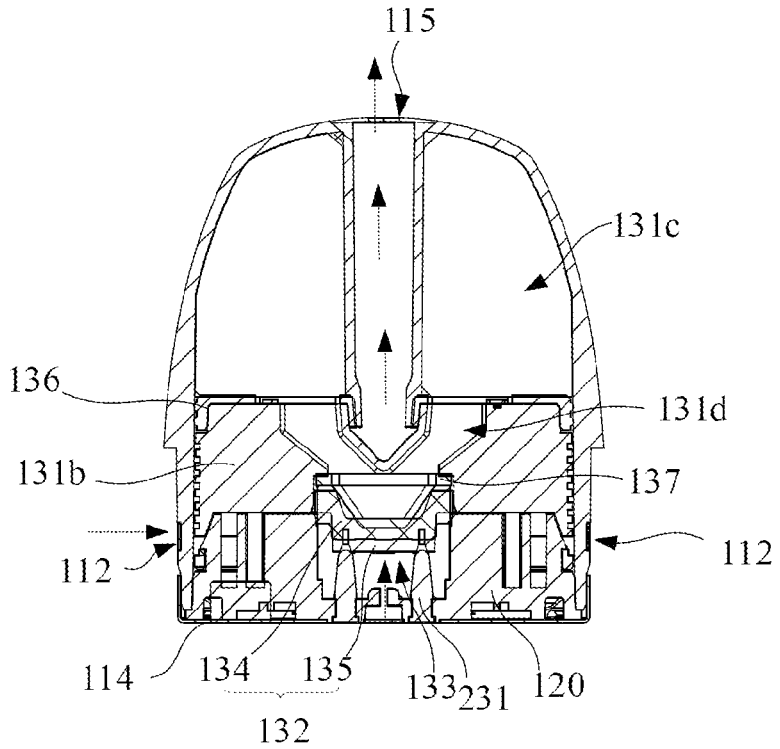
FIG. 7 is another cross-sectional view of the vaporizer shown in FIG. 3.

The vaporization core 130 is a component configured to vaporize the vaporizable medium. Optionally, the vaporization core 130 includes a heating assembly 132 and a liquid storage tank 131 that is configured to carry a vaporizable medium. The heating assembly 132 is mounted on the vaporization base 120, and the heating assembly 132 and the vaporization base 120 form a vaporization cavity 133, and the heating assembly 132 is configured to vaporize the vaporizable medium in the liquid storage tank 131. The vaporization cavity 133 is in communication with the air inlet hole 121, the housing 110 is further provided with an air outlet 115, and the air outlet 115 is in communication with the vaporization cavity 133. Referring to FIG. 6 and FIG. 7 (in FIG. 6 and FIG. 7, dashed arrows indicate directions of the flow of air), during operation of the vaporizer 100, the vaporizable medium in the liquid storage tank 131 is vaporized on the heating assembly 132 to form aerosol and the aerosol is released into the vaporization cavity 133, external air enters through the air inlet 112 and flows into the vaporization cavity 133 through the air inlet hole 121 in communication with the air inlet 112, and then the aerosol in the vaporization cavity 133 flows out of the air outlet 115 in communication with the vaporizer 100 together with air.

Specifically, the heating assembly 132 includes a liquid guide member 134 and a heating member 135 that is close to the liquid guide member 134. The liquid guide member 134 is mounted on the vaporization base 120. The liquid guide member 134 is located between the liquid storage tank 131 and the heating member 135, and the heating member 135 is close to the vaporization cavity 133. The vaporizable medium in the liquid storage tank 131 reaches the heating member 135 through the liquid guide member 134 and is vaporized into aerosol by the heating member 135, and the aerosol is released into the vaporization cavity 133. More specifically, the liquid storage tank 131 includes a tank opening, the liquid guide member 134 is close to the tank opening, and an edge of the liquid guide member 134 close to the tank opening is connected to a tank wall of the liquid storage tank 131 forming the tank opening in a sealed manner, so that a vaporizable medium flowing out of the tank opening of the liquid storage tank 131 can reach the heating member 135 through the liquid guide member 134.

Optionally, the liquid guide member 134 is a porous ceramic body. Certainly, the liquid guide member 134 is not limited to a porous ceramic body, and may alternatively be of another structure capable of guiding liquid.

Optionally, the liquid storage tank 131 includes a tank housing 131*a* and a tank cover 131*b*. The tank housing 131*a* includes a liquid storage cavity 131*c*, and the liquid storage cavity 131*c* includes an exit. The tank cover 131*b* is located on the vaporization base 120. The tank housing 131*a* covers the tank cover 131*b* and blocks the exit, and is connected to the tank cover 131*b* in a sealed manner. A liquid outlet channel 131*d* is provided on the tank cover 131*b*. The liquid outlet channel 131*d* includes a liquid inlet and a liquid outlet in communication with the liquid inlet, and the liquid inlet is in communication with the exit. An edge of the liquid guide member 134 is connected to an end of the liquid outlet channel 131*d* close to the liquid outlet in a sealed manner. In the illustrated embodiment, there are two liquid outlet channels 131*d*, and the two liquid outlet channels 131*d* are spaced apart from each other. Certainly, in other embodiments, the quantity of liquid outlet channels 131*d* is not limited to the above, and may alternatively be another value. It may be understood that, in some embodiments, the tank housing 131*a* may be omitted. When the tank housing 131*a* is omitted, the top cover 113 and the tank cover 131*b* form the liquid storage tank configured to carry the vaporizable medium.

In some embodiments, the vaporization core 130 further include a first seal member 136. The first seal member 136 is located between the tank housing 131*a* and the tank cover 131*b*, and is configured to seal a gap between the tank housing 131*a* and the tank cover 131*b*. In the illustrated embodiment, the first seal member 136 is approximately in a shape of a bottle cap. The first seal member 136 covers the tank cover 131*b*, an outer side wall of the first seal member 136 is connected to an inner wall of the tank housing 131*a* in a sealed manner, and a through hole corresponding to the liquid outlet channel 131*d* is provided on the first seal member 136. Optionally, a material of the first seal member 136 is silicone. Certainly, the material of the first seal member 136 is not limited to silicone, and may alternatively be another material that can be used as a seal member. It may be understood that, in some embodiments, the first seal member 136 may be omitted. When the first seal member 136 is omitted, the tank cover 131*b* may be connected to the tank housing 131*a* in another sealed manner. For example, the tank cover 131*b* is a silicone tank cover 131*b*, and the tank cover 131*b* is directly connected to the tank housing 131*a* in a sealed manner.

In some embodiments, the vaporization core 130 further includes a second seal member 137. The second seal member 137 is located between the tank cover 131*b* and the liquid guide member 134, and is configured to seal a gap between the tank cover 131*b* and the liquid guide member 134. It may be understood that, in some embodiments, the second seal member 137 may be omitted. When the second seal member 137 is omitted, the tank cover 131*b* may be connected to the liquid guide member 134 in another sealed manner. For example, the tank cover 131*b* is a silicone tank cover 131*b*, and the tank cover 131*b* is directly connected to the liquid guide member 134 in a sealed manner.

Certainly, the vaporizer 100 further includes an air outlet channel. The air outlet channel is configured to communicate the vaporizer 100 with the air outlet 115. In the illustrated embodiment, a first channel for air venting is provided on the tank cover 131*b*, and a second channel for air venting is provided on the vaporization base 120, where the first channel is in communication with the second channel to form the air outlet channel. One end of the second channel is in communication with the vaporization cavity 133, an other end of the second channel is in communication with the first channel, and one end of the first channel far away from the second channel is in communication with the air outlet 115. In the illustrated embodiment, a third channel 116 is formed on the housing 110, where one end of the third channel 116 is in communication with the first channel, and an other end of the third channel is in communication with the air outlet 115. It may be understood that, in other embodiments, the air outlet channel may be provided on only the vaporization base 120 or may be provided on only the vaporization base 120, and specific adjustments may be made according to an actual situation.

Optionally, the battery assembly 200 is detachably connected to the vaporizer 100. In some embodiments, the battery assembly 200 is magnetically connected to the vaporizer 100. Optionally, a magnet is arranged on one side of the vaporization base 120 close to the inner bottom surface 111, and a metal member (for example, an iron column) is arranged in the battery assembly 200, where the metal member and the magnet can attract each other, so that the vaporizer 100 and the battery assembly 200 can be assembled together under the action of magnetic attraction. Certainly, in other embodiments, the battery assembly 200 and the vaporizer 100 may alternatively be assembled together in another detachable connection manner.

Specifically, the battery assembly 200 includes a power supply 210 and a battery case 220. The power supply 210 is accommodated in the battery case 220, and the power supply 210 is electrically connected to the heating member 135 of the vaporization core 130 through an electrical connector. In an embodiment, the electrical connector includes an ejector pin 231, and an ejector pin hole is provided on the housing bottom. The ejector pin 231 passes through the ejector pin hole, the vaporization base 120, and the vaporization cavity 133 and is electrically connected to the heating member 135, and the ejector pin 231 can move back and forth in an axial direction of the vaporizer 100, to switch off or switch on an electrical connection to the heating member 135. Optionally, the vaporizer 100 further includes a third seal member configured to seal a gap between the ejector pin 231 and a hole wall forming the ejector pin hole. Certainly, when the housing 110 is omitted, the ejector pin 231 passes through the vaporization base 120 and the vaporization cavity 133 and is electrically connected to the heating member 135. Optionally, a material of the ejector pin 231 is gold-plated brass.

A method for assembling the foregoing electronic vaporization device 10 includes the following steps: assembling the liquid storage tank 131, the heating assembly 132, and the vaporization base 120 into the housing 110, to obtain the vaporizer 100; assembling the power supply 210 and the electrical connector into the battery case 220, to obtain the battery assembly 200; and electrically connecting the ejector pin 231 of the vaporizer 100 to the power supply 210 of the battery assembly 200, to obtain the electronic vaporization device 10.

Specifically, the step of assembling the liquid storage tank 131, the heating assembly 132, and the vaporization base 120 into the housing 110 includes: sleeving the first seal member 136 on the tank cover 131*b* and then connecting the tank cover to the tank housing 131*a* in a sealed manner; connecting the tank cover 131*b* to the liquid guide member 134 in a sealed manner through the second seal member 137; mounting the vaporization base 120 on the tank cover 131*b* and the heating assembly 132, and pressing the ejector pin 231 into the vaporization base 120; and placing the vaporization base 120 together with the heating assembly 132 and the liquid storage tank 131 that are mounted on the vaporization base 120 on the bottom cover and then covering with the top cover 113.

It may be understood that, the method for assembling the foregoing electronic vaporization device is not limited to the above, and may alternatively be another method.

The technical features in the foregoing embodiments may be randomly combined. For concise description, not all possible combinations of the technical features in the embodiments are described. However, provided that combinations of the technical features do not conflict with each other, the combinations of the technical features are considered as falling within the scope described in this specification.

The foregoing embodiments only describe several implementations of the present application to facilitate specific and detailed understanding of the technical solutions of the present application, but cannot be construed as a limitation to the patent scope of the present application. It should be noted that, for a person of ordinary skill in the art, several transformations and improvements can be further made without departing from the idea of the present application. These transformations and improvements all fall within the protection scope of the present application. It is to be understood that, technical solutions obtained based on the technical solutions provided in the present application by a person skilled in the art through logical analysis, reasoning, or limited experimentation shall all fall within the protection scope of the appended claims of the present application. Therefore, the protection scope of the present application shall be subject to the content of the appended claims, and the specification and the accompanying drawings can be used to illustrate the content of the claims.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporizer, comprising:

a housing comprising a side wall and a housing bottom connected to the side wall, the housing bottom comprising an inner bottom surface, the side wall and the housing bottom forming an accommodation cavity, an air inlet being provided on the side wall so as to allow entry of external air through the air inlet during operation of the vaporizer;

a vaporization base located in the accommodation cavity, there being a gap between the vaporization base and the inner bottom surface, an air inlet hole being provided on the vaporization base, the air inlet hole being in communication with the air inlet through the gap; and a vaporization core located in the accommodation cavity and mounted on the vaporization base, the vaporization core being in communication with the air inlet hole, wherein the housing comprises a top cover and a bottom cover, wherein the top cover is detachably connected to the bottom cover, and wherein the air inlet is located at a joint between the top cover and the bottom cover.

2. The vaporizer of claim 1, wherein a liquid storage groove is provided on a side of the vaporization base close to the inner bottom surface such that liquid flowing out of the air inlet hole is flowable into the liquid storage groove under a capillary force.

3. The vaporizer of claim 1, wherein a liquid storage groove and a liquid guide trench are provided on a side of the vaporization base close to the inner bottom surface, the liquid guide trench being located between the air inlet hole and the liquid storage groove and configured to guide liquid flowing out of the air inlet hole into the liquid storage groove.

4. The vaporizer of claim 2, wherein an opening of the liquid storage groove faces the inner bottom surface, and wherein there is a spacing between a side of the liquid storage groove close to the inner bottom surface and the inner bottom surface.

5. The vaporizer of claim 2, wherein the top cover and the bottom cover form the accommodation cavity for accommodating the vaporization base and the vaporization core, and the inner bottom surface comprises a surface of the bottom cover, wherein the liquid storage groove comprises an opening facing the bottom cover, there being a spacing between a side of the liquid storage groove close to the bottom cover and the bottom cover.

6. The vaporizer of claim 5, wherein the bottom cover comprises a hollow structure with one end open and an other end closed, wherein the vaporization base is located inside the bottom cover, a side wall of the vaporization base is connected to an inner side wall of the bottom cover in a sealed manner, and a side of the vaporization base close to the bottom cover and the bottom cover form an air inlet channel, and wherein the air inlet is located on the side wall of the bottom cover and is in communication with the air inlet channel, the air inlet channel being in communication with the air inlet hole.

7. The vaporizer of claim 6, wherein the air inlet hole is located in a middle of the vaporization base, wherein an air groove is provided on a side of the vaporization base close to the bottom cover, the air groove being in communication with a liquid guide trench, a groove wall of the air groove being in contact with the bottom cover to form the air inlet channel, and a notch being provided on the groove wall of the air groove, and wherein the notch is configured to cause the air inlet channel to be in communication with both the opening of the liquid storage groove and the air inlet hole.

8. The vaporizer of claim 1, wherein a cross-section of the housing is elliptical, and wherein an orthographic projection of the air inlet on the cross-section of the housing is located on a major axis of the cross-section.

9. The vaporizer of claim 8, wherein the air inlet comprises two air inlets, and wherein orthographic projections of the two air inlets on the cross-section of the housing coincide with end-points of the major axis.

10. The vaporizer of claim 1, wherein the vaporization core comprises a heating assembly and a liquid storage tank configured to carry a vaporizable medium, wherein the heating assembly is mounted on the vaporization base and is configured to vaporize the vaporizable medium in the liquid storage tank, wherein the heating assembly and the vaporization base form a vaporization cavity, and wherein the air inlet hole is in communication with the vaporization cavity, the housing comprises an air outlet, and the air outlet is in communication with the vaporization cavity.

11. The vaporizer of claim 10, wherein the heating assembly comprises a liquid guide member and a heating member, wherein the heating member is mounted on the vaporization base, and the liquid guide member is located between the liquid storage tank and the heating member, and wherein the vaporizable medium in the liquid storage tank reaches the heating member through the liquid guide member so as to be vaporized by the heating member.

12. The vaporizer of claim 11, wherein the liquid storage tank comprises a tank housing and a tank cover; the tank housing comprises a liquid storage cavity, and the liquid storage cavity comprises an exit; the tank cover is located on the vaporization base, the tank cover covers the tank housing and blocks the exit and is connected to the tank housing in a sealed manner; a liquid outlet channel is provided on the tank cover, the liquid outlet channel comprises a liquid inlet and a liquid outlet, and the liquid inlet is in communication with the exit; an edge of the liquid guide member is connected to the liquid outlet in a sealed manner; and/or wherein the liquid guide member comprises a porous ceramic body.

13. The vaporizer of claim 12, wherein an air outlet channel is provided on the tank cover and/or the vaporization base, and wherein the vaporization cavity is in communication with the air outlet channel such that the air outlet channel is in communication with the air outlet.

14. An electronic vaporization device, comprising:

the vaporizer of claim 1; and a battery assembly electrically connected to a vaporization core of the vaporizer.

15. The vaporizer of claim 1, wherein a through hole is provided on each of the top cover and the bottom cover.

16. The vaporizer of claim 15, wherein the through hole on the top cover and the through hole on the bottom cover are located at a junction of the top cover and the bottom cover.

17. The vaporizer of claim 16, wherein the through hole of the top cover and the through hole of the bottom cover are communicated to form the air inlet.

18. The vaporizer of claim 1, wherein the vaporization core comprises a tank cover with a plurality of grooves at an outermost periphery of the tank cover, and wherein that the side wall is configured to surround the plurality of grooves.

19. A vaporizer, comprising:

a housing comprising a side wall and a housing bottom connected to the side wall, the housing bottom comprising an inner bottom surface, the side wall and the housing bottom forming an accommodation cavity, an air inlet being provided on the side wall so as to allow entry of external air through the air inlet during operation of the vaporizer;

a vaporization base located in the accommodation cavity, there being a gap between the vaporization base and the inner bottom surface, an air inlet hole being provided on the vaporization base, the air inlet hole being in communication with the air inlet through the gap; and a vaporization core located in the accommodation cavity and mounted on the vaporization base, the vaporization core being in communication with the air inlet hole, wherein the housing comprises a top cover and a bottom cover, wherein the top cover is detachably connected to the bottom cover, and wherein the air inlet is located on a side wall of the bottom cover.

20. A vaporizer, comprising:

a housing comprising a side wall and a housing bottom connected to the side wall, the housing bottom comprising an inner bottom surface, the side wall and the housing bottom forming an accommodation cavity, an air inlet being provided on the side wall so as to allow entry of external air through the air inlet during operation of the vaporizer;

a vaporization base located in the accommodation cavity, there being a gap between the vaporization base and the inner bottom surface, an air inlet hole being provided on the vaporization base, the air inlet hole being in communication with the air inlet through the gap; and a vaporization core located in the accommodation cavity and mounted on the vaporization base, the vaporization core being in communication with the air inlet hole, wherein the housing comprises a top cover and a bottom cover, wherein the top cover is detachably connected to the bottom cover, and wherein the air inlet is located on a side wall of the top cover.

* * * * *